United States Patent [19]

D'Amico et al.

[11] 4,434,904

[45] Mar. 6, 1984

[54] BOTTLE CLOSURE

[75] Inventors: Richard D'Amico, Gurnee; Thomas A. Fowles, McHenry, both of Ill.; David A. Winchell, Twin Lakes, Wis.

[73] Assignee: Baxter Travenol Laboratories, Inc., Deerfield, Ill.

[21] Appl. No.: 383,486

[22] Filed: Jun. 1, 1982

Related U.S. Application Data

[63] Continuation of Ser. No. 157,438, Jun. 9, 1980, abandoned.

[51] Int. Cl.[3] ..... B65D 41/32

[52] U.S. Cl. ..... 215/232; 215/253

[58] Field of Search ..... 215/232, 252, 253

[56] References Cited

U.S. PATENT DOCUMENTS

| | | | |
|---|---|---|---|
| 2,375,388 | 5/1945 | Ryan | 215/352 X |
| 3,804,282 | 4/1974 | Komendowski | 215/32 |
| 3,974,008 | 8/1976 | Choksi | 215/253 X |
| 4,093,093 | 6/1978 | Fowles et al. | 215/251 |
| 4,096,962 | 6/1978 | Riuli et al. | 215/32 |
| 4,111,325 | 9/1978 | Bellamy et al. | 215/232 |
| 4,207,990 | 6/1980 | Weiler | 215/32 X |

*Primary Examiner*—Donald F. Norton

*Attorney, Agent, or Firm*—Paul C. Flattery; John P. Kirby, Jr.; Gary W. McFarron

[57] ABSTRACT

A plastic container and a three-piece closure system therefor are disclosed. The container has a threaded neck defining a dispensing outlet. A separate closure covers the dispensing outlet and is heat-sealed to the threaded neck, forming a frangible section which may be broken to remove the closure. An internally threaded jacking ring is threadedly received on the neck, and includes a plurality of inwardly directed flexible fingers, which snap into an annular groove in the closure when the jacking ring is threaded onto the neck. To break the frangible portion and open the container, the jacking ring is rotated in the direction to remove it, so that the jacking ring fingers press against the top edge of the recess in the closure and actually pry the closure away from the container neck.

5 Claims, 10 Drawing Figures

BOTTLE CLOSURE

This is a continuation of application Ser. No. 157,438, filed June 9, 1980, now abandoned The present application generally relates to plastic containers, and more particularly, to hermetically sealed plastic containers which may be easily opened for removal of the contents.

Plastic containers, because of their relative low cost and inertness have found increasing application in the medical field, particularly for the storage of sterile medical fluids, such as sterile water, saline solution and the like. Depending on the particular application or customer preference, it may be desirable for the container to be resealable to provide for short-term storage of unused contents. On the other hand, out of an abundance of caution, it may be preferred that the container not be resealable so that the unused contents must be disposed of.

A wide variety of containers and closure systems for plastic containers have been proposed for the storage of sterile medical fluids. For the purpose of illustration only, various examples of these may be found in one or more of the following U.S. Pat. Nos.: 4,111,325; 4,091,949; 4,093,093; 3,923,182, 3,730,372; and 4,176,755.

U.S. Pat. No. 3,730,372 discloses a one-piece formed, filled and sealed container, which uses a threaded ring to open the container. By twisting the ring, an interior groove in the cap is pressed against a matching shoulder on the container to sever the sealed top of the container by compression along a line of weakness. This one-piece container requires relatively complex molding steps and equipment which slow the production rate and increase the cost of the finished product.

U.S. Pat. No. 4,111,325 illustrates a relatively sophisticated, four-piece non-resealable container and closure system for containing parenteral fluids and the like. There, by turning an outer threaded ring, a first closure is pried away from the container, breaking a frangible seal. With furhter rotation of the outer-ring, the first closure is caused to engage and pry off a primary closure, also sealed to a container along a frangible line of weakness. This closure system is quite satisfactory, but requires at least two heat-sealing steps to assemble the four-part closure structure.

Accordingly, it is an object of the present invention to provide an alternative and generally improved container and closure system for use in storing sterile medical fluids and the like.

It is a further object of the present invention to provide a container and closure system which is easy to assemble at relatively low cost and without requiring complex equipment or assembly processes.

It is a further object to provide a three-piece closure system, including the primary closure, which is easy to assemble and provides a simple one-step opening operation.

These and other objects of the present invention are set forth in the following detailed description of the preferred embodiment of the present invention illustrated in the attached drawings, of which:

Figure 1:
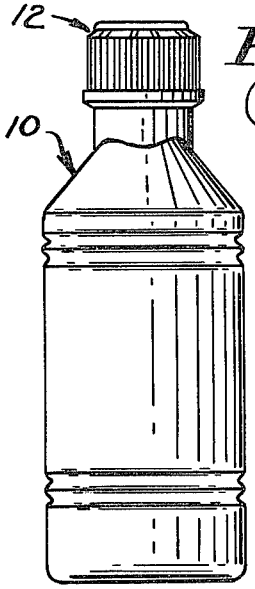
FIG. 1 is a front elevational view of a container and closure system embodying the present invention.

The present invention is generally embodied in a plastic container 10 for storing sterile medical fluids such as sterile water, saline solution and the like. A three-element closure system, generally at 12, hermetically seals the container to preserve the sterility of the contents, but is easy to open in one twist-off operation. In accordance with the present invention, the container has a threaded neck portion 14, which defines the dispensing outlet 16 of the container, and is hermetically closed and sealed by a separately formed plastic closure element 18. The closure element is fused to the periphery of the container neck, to form a frangible, break-apart line of weakness 20 that must be fractured to remove the closure from the container. To provide a means for removing the closure, a jacking ring 22 is threadedly received onto the neck. The jacking ring has a plurality of inwardly extending fingers 24 which extend into a peripheral groove or recess 26 in the closure element.

When the contents of the container are needed, the jacking ring 22 is simply rotated, e.g., counter-clockwise, in a normal unscrewing motion. The fingers of the jacking ring, engage against a downwardly-facing abutment surface 28 defined by the recess 26, prying the closure element 18 upwardly until the frangible line of weakness breaks to open the container for removal of the contents. The closure member 18 is retained by the fingers 24 to permit resealing of the container if desired. A thin inwardly extending seal 30 in the closure element 18 engages against the beveled pouring lip 32 of the dispensing outlet to aid in sealing the container and protecting the pouring lip against unnecessary contamination.

Figure 2:
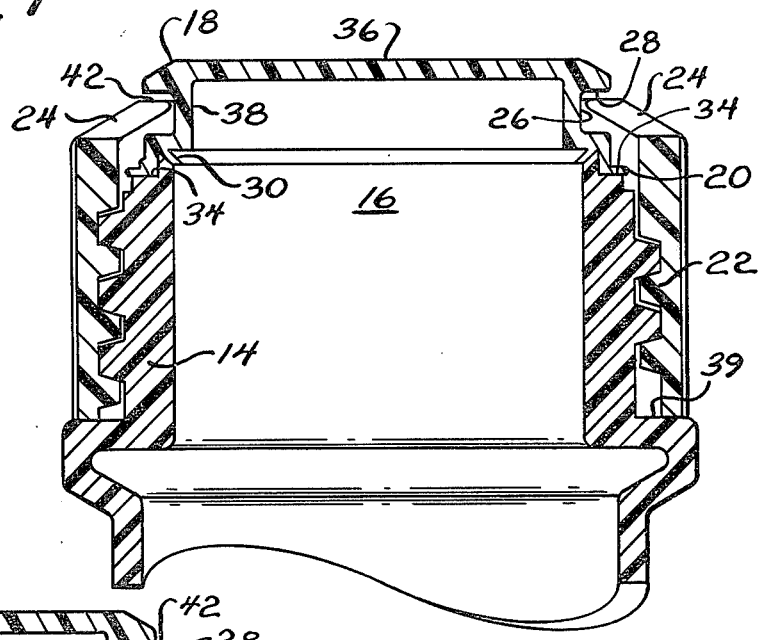
FIG. 2 is a vertical cross-sectional view through the upper portion of the container and closure system of FIG. 1.
Figure 3:
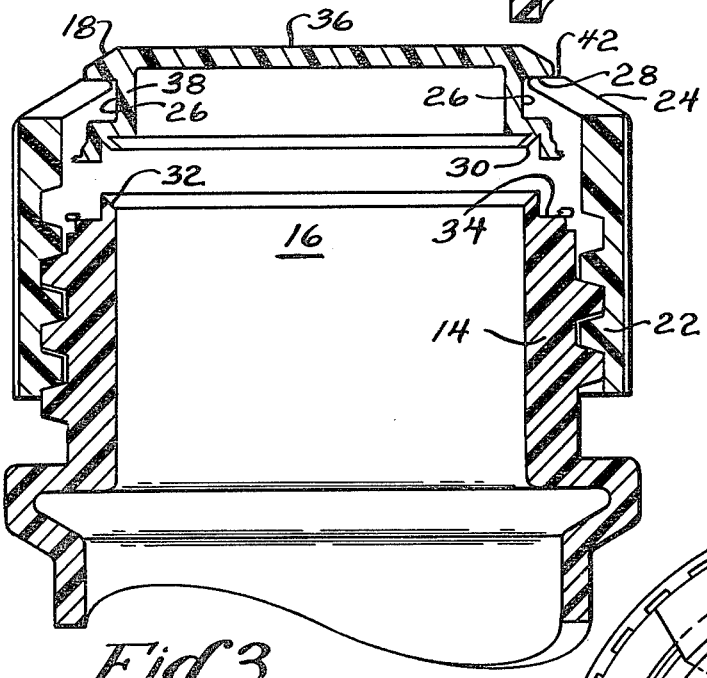
FIG. 3 is a vertical cross-sectional view, similar to FIG. 2, but showing the closure element of the container in a pried-off position.
Figure 4:
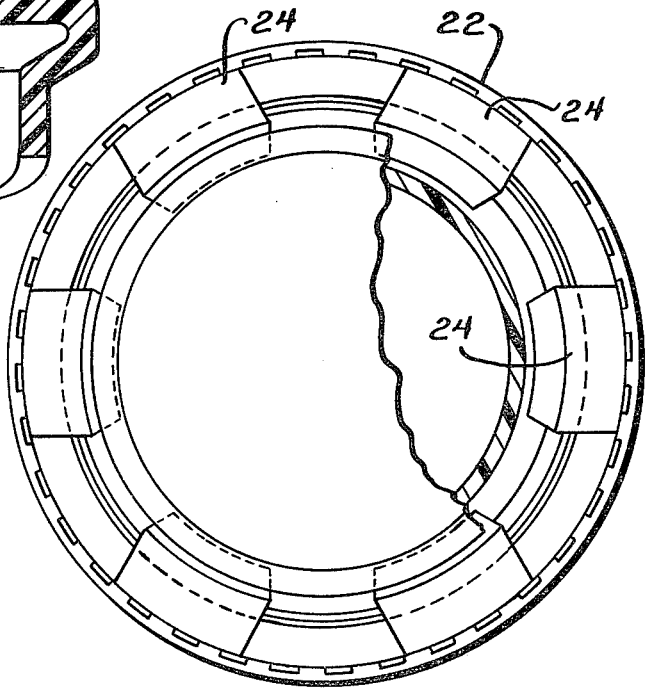
FIG. 4 is a top plan view, partially in section, of the container of FIG. 1.

Turning now to a more detailed description of the preferred embodiment of the present invention, a typical plastic container 10 for containing medical fluids and the like is shown in FIG. 1. The container may have any of a variety of shapes and may be constructed of different plastic materials, although formulations of polyethylene and polypropylene are preferred. The upper end of the container, as best seen in FIG. 2, terminates with the threaded neck portion 14, which defines the dispensing outlet 16 of the container. The inside surface of the dispensing outlet 16 is beveled to provide the dripless pouring lip 32, and circumscribing the dispensing outlet, above the threads, the neck portion 14 also has a flat, generally radially extending shoulder 34, which represents the sealing surface to which the closure element 18 is heat-sealed.

Figure 5:
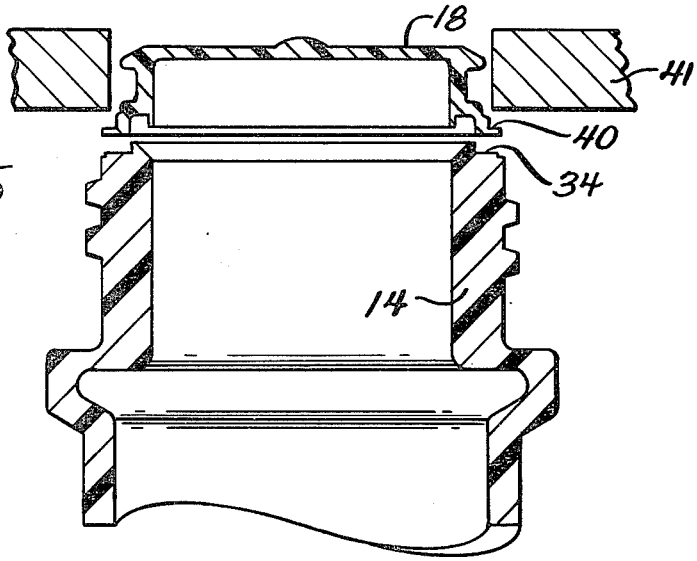
FIG. 5 is a vertical sectional view depicting the operation of sealing the separate closure element to the container.
Figure 6:
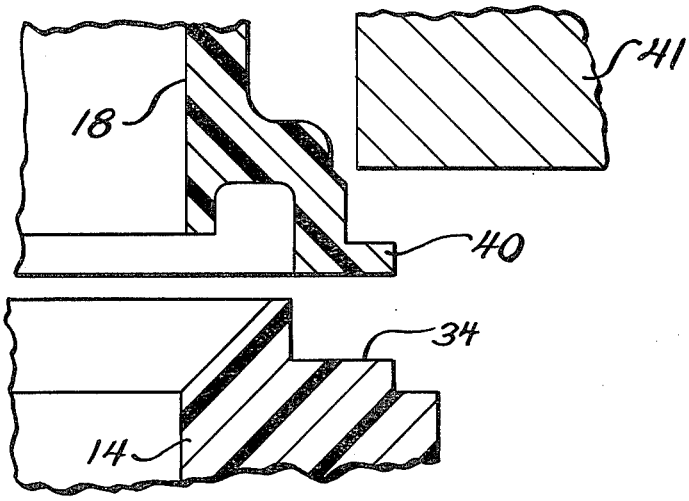
FIG. 6 is an enlarged view of the sealing operation of FIG. 5, broken away from the remainder of the container and closure element.
Figure 7:
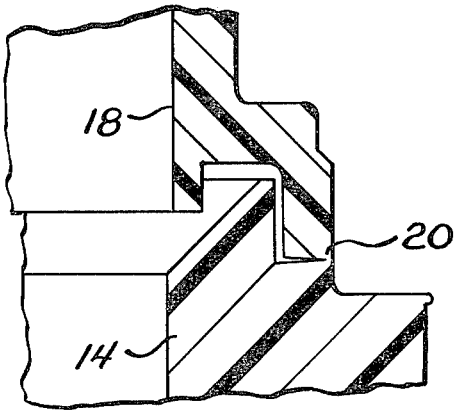
FIG. 7 is an enlarged sectional view of the completed seal between the closure element and container.

The closure element 18 is molded separately from the container 10 and attached later, after the container has been filled. The closure element 18 is plastic, and made of a material that is compatible for melt-to-melt sealing with the container material. The closure element generally has a flat top wall surface 36, and a depending side wall or skirt 38. A reduced diameter portion in the side wall defines the peripheral recess or groove 26, into which the resilient fingers 24 of the jacking ring 22 are positioned. The lower edge of the side wall 38 terminates in a radially outwardly extending brim or foot 40 which rests atop the shoulder 34 on the container neck. During assembly, the closure is fused to the container by a melt-to-melt seal between the brim 40 and the container sealing surface 34. One technique for sealing the closure to the container is illustrated in FIGS. 5–7. As shown there, the separately molded closure element is placed atop the shoulder 34 on the container neck. A heated annular die 41 is pressed against the brim 40, melting the brim and a portion of the shoulder (FIG. 7) to fuse the closure to the container, forming the thin frangible plastic web 20 therebetween.

To aid in sealing the container and to protect the pouring lip 32 after the container has been opened and resealed, the closure element also has the thin sealing web 30 extending around the inside surface to closely cover the pouring lip when the closure element is attached to the container.

After the container 10 has been filled and the closure element 18 fused to the top of the neck portion 14, the jacking ring 22 is threaded onto the neck. The preferred jacking ring, illustrated in FIGS. 1–4, has a vertical side wall, and is substantially open at the top to telescopically receive the closure element therethrough. As the ring is threaded onto the neck, the naturally resilient fingers 24 spread as they engage the edge of the top wall of the closure element. When the ring is threaded further onto the container, the fingers snap back into the groove or recess 26 in the closure element. At this position, the lower edge of the jacking ring is adjacent to or in contact with a radial shoulder 39 on the container, with the fingers extending into the recess or groove 26.

When the contents of the container are needed, the jacking ring is twisted in the direction to move it upwardly, away from the body of the container—the normal unscrewing direction is counter-clockwise, as the jacking ring moves upwardly, the upper surfaces 42 of the jacking ring fingers 24 engage a downwardly facing abutment surface 28 formed by one wall of the recess 26. Further rotation of the jacking ring in the same direction causes an upward prying action on the closure element, which results in breaking the frangible line of weakness 20 formed between the closure and the container neck, thus opening the container for immediate usage. The mechanical advantage of the threads allows a person of ordinary strength to break the seal without difficulty. Because the closure element is retained between the flexible fingers 24, if all the contents are not used, the container may be resealed upon threading the jacking ring 22 back onto the container. Pressure of the fingers 24 against the bottom surface of the recess 26 draws the closure element into close contact with the neck, in which event the sealing lip 30 of the closure element protects the pouring lip 32 of the container against further contamination.

Figure 8:
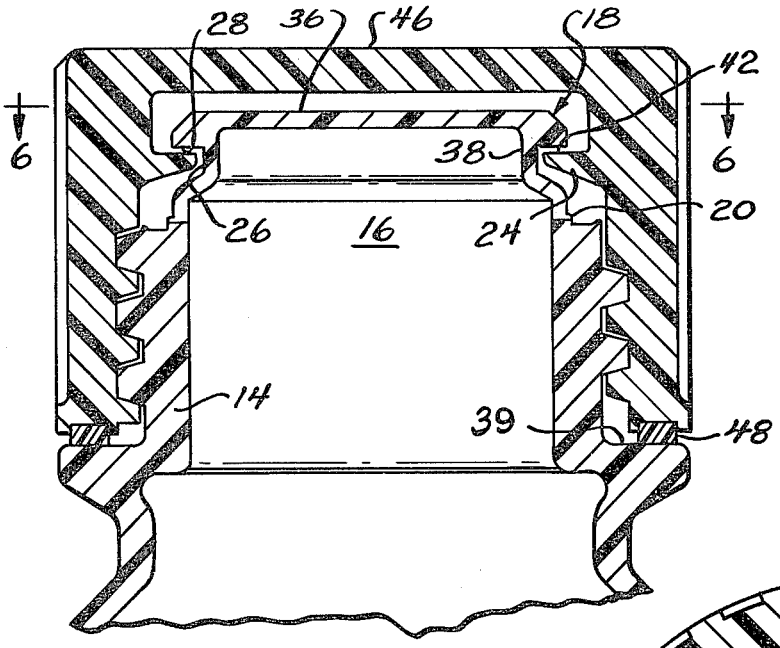
FIG. 8 is a vertical cross-sectional view of the top of a container and closure system, illustrating an alternative embodiment of the present invention.
Figure 9:
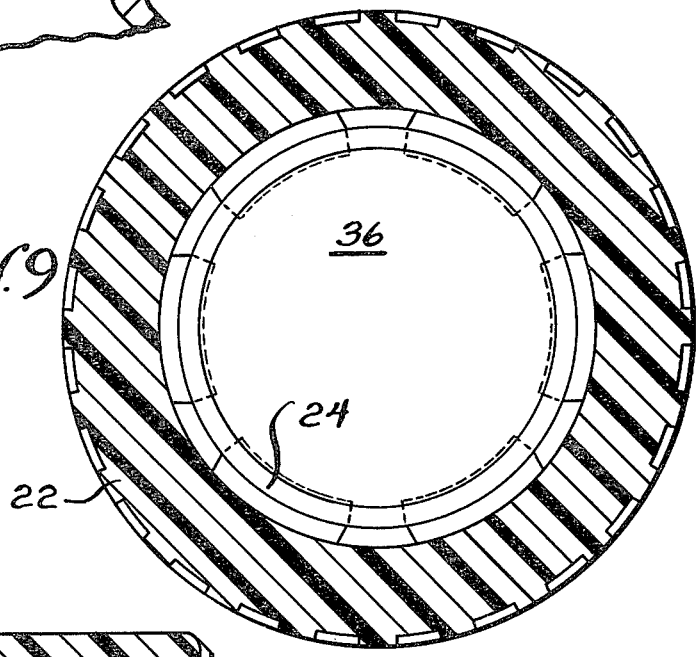
FIG. 9 is a sectional view of the container and closure system of FIG. 8 taken along line 9—9.
Figure 10:
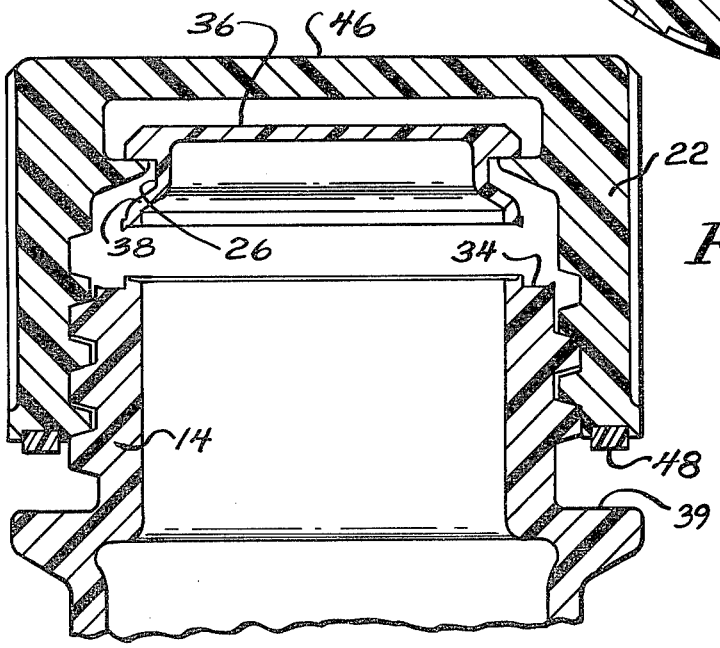
FIG. 10 is a vertical cross-sectional view of the container of FIG. 8 showing the container in an open condition.

An alternative embodiment of the present invention is illustrated in FIGS. 8–10, with the same numbers representing the same elements as discussed above. The container 10 and closure element 18 are of the same construction as the earlier described embodiment and are fused together in the manner described above. The jacking ring 22 of the alternative embodiment, however, has a top wall 46 which completely encloses the closure element 18. The jacking ring is internally threaded for engagement with the neck portion 14 of the container 10 and has a plurality of flexible fingers 24 extending radially inwardly from the side wall for positioning within recess 26. The top wall of the jacking ring, as it completely encloses the closure element, provides a barrier to dust and the like. In addition, the lower edge of the jacking ring has a channel, adapted to receive a resilient gasket or O-ring 46 which seals against the shoulder 39 of the container, providing additional protection for the surface of the container and closure element. Preferably the gasket 48 is attached to the jacking ring 22, although it may also be attached to the shoulder 40 of the container.

As may be seen from the above discussion, the present invention provides a unique, easy-to-assemble container and closure system which provides a primary hermetic seal with a minimum of expensive processes or equipment and yet is an easy-opening system that permits the container to be opened with one twist of the jacking ring. Although the present invention has been described in terms of the preferred embodiments, it is intended that the present invention, as set forth in the following claims, include those equivalent structures, some of which may be immediately apparent and others of which may be apparent only after some study.

What is claimed is:

1. A three-piece quick-opening and reclosable container and closure system comprising:

a one-piece plastic container including an externally threaded neck portion defining a dispensing outlet, and an annular outwardly extending sealing surface above said threaded portion:

a separately formed plastic closure member covering said dispensing outlet and peripherally heat sealed to said neck portion along said sealing surface to define a frangible section therebetween, said closure member having a peripheral recess defined by a reduced diameter portion; and a separately formed internally threaded jacking ring threadedly engaged on said neck, said jacking ring having a plurality of radially inwardly directed flexible fingers adapted to snap into said recess upon screw attachment of said jacking ring to said container neck portion, and to break said frangible section by prying said closure member off when said jacking ring is removed by unscrewing from said container neck portion, the extension of said fingers into said recess retaining said closure member in association with said jacking ring whereby upon reattachment of said jacking ring to said container, said closure member closes said dispensing outlet.

2. A container in accordance with claim 1, said container further comprises an outwardly extending abutment surface below said threaded neck portion and wherein one of said jacking ring and said abutment surface includes an annular gasket to provide a seal therebetween when said jacking ring is threaded onto said neck.

3. A container in accordance with claim 1 wherein said jacking ring has a top wall to enclose said closure completely.

4. A container in accordance with claim 1 wherein said neck portion defines a beveled pouring lip around said dispensing outlet and said closure comprises an annular internal seal adapted to engage said lip when said closure covers said outlet.

5. A container in accordance with claim 4, wherein said peripheral recess on said closure includes an upwardly facing surface engageable by said fingers when said jacking ring is threaded onto said container to draw said internal seal into engagement with said pouring lip upon resealing of said container after opening.

* * * * *